US008550378B2

(12) United States Patent
Mazooji et al.

(10) Patent No.: US 8,550,378 B2
(45) **Date of Patent: *Oct. 8, 2013**

(54) AUTOMATED CLEANSING SPRAYER

(75) Inventors: Amber N. Mazooji, Cambridge, MA (US); Terry M. Kovara, Racine, WI (US); Peter M. Neumann, Racine, WI (US); Michael W. Allen, Glen Allen, VA (US); Stephen D. Beverley, Midlothian, VA (US); Paul M. Blankenship, Glen Allen, VA (US); Mark K. Romandy, Midlothian, VA (US)

(73) Assignee: S.C. Johnson & Son, Inc., Racine, WI (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/905,616

(22) Filed: Oct. 15, 2010

(65) Prior Publication Data

US 2011/0024466 A1 Feb. 3, 2011

Related U.S. Application Data

(62) Division of application No. 10/439,467, filed on May 16, 2003, now Pat. No. 7,837,132.

(60) Provisional application No. 60/383,687, filed on May 28, 2002.

(51) Int. Cl.
*A62C 11/00* (2006.01)

(52) U.S. Cl.
USPC ..... 239/333; 239/263.3; 239/264; 239/332; 239/379; 222/82; 222/88; 222/333; 222/181.1; 222/325

(58) Field of Classification Search
USPC ..... 239/263.1–265, 329–333, 345, 347, 239/379; 222/82, 83, 83.5, 88, 333, 222/181.1–181.3, 325, 189.11, 526
See application file for complete search history.

(56) References Cited

U.S. PATENT DOCUMENTS 2,773,665 A 12/1956 Netardus et al.
2,872,245 A 2/1959 Groth (Continued)

FOREIGN PATENT DOCUMENTS

EP 365 770 B1 5/1990
EP 369 722 B1 5/1990

(Continued)

OTHER PUBLICATIONS

On or about Oct. 26, 2001 a U.S. provisional application was filed by Michael Allen, Paul Blanketship and Jeff Mauch for a "Cleaning Device for Enclosed Areas", which is enclosed. Two of the inventors are also inventors of the present application. However, it has not been determined whether any of the content of that application is prior art to this application. For the present, the Examiner should consider that as prior art, with the applicants reserving the right to determine whether any such content is in fact prior art.

*Primary Examiner* — Christopher Kim

(57) ABSTRACT

An automated sprayer for spraying the walls of a shower enclosure with a liquid cleanser dispenses the cleanser using a pumping system and rotatable spray head. The sprayer has a showerhead mountable housing with an adjustable hanger. There is a portion of the housing for supporting a bottle of cleanser in an inverted fashion. The bottle is vented through a piercing post. A single motor both drives the pump and rotates the spray head.

3 Claims, 9 Drawing Sheets

(56) References Cited

U.S. PATENT DOCUMENTS

| | | | | |
|---|---|---|---|---|
| 2,977,963 | A | 4/1961 | Klint | |
| 3,132,350 | A | 5/1964 | Carlson | |
| 3,230,550 | A | 1/1966 | Carlson | |
| 3,542,240 | A | 11/1970 | Solowey | |
| 3,952,918 | A | 4/1976 | Poitras et al. | |
| 4,183,105 | A | 1/1980 | Womack | |
| 4,189,098 | A | 2/1980 | Wagner et al. | |
| 4,216,553 | A | 8/1980 | Haberle | |
| 4,218,013 | A | 8/1980 | Davison | |
| 4,364,520 | A | 12/1982 | Weber, Sr. | |
| 4,383,341 | A | 5/1983 | Altman | |
| 4,391,309 | A | 7/1983 | Steiner | |
| 4,651,903 | A | 3/1987 | Pagliai | |
| 4,872,225 | A | 10/1989 | Wagner | |
| 4,921,150 | A | 5/1990 | Lagergren et al. | |
| 4,998,850 | A | 3/1991 | Crowell | |
| 5,014,884 | A | 5/1991 | Wunsch | |
| 5,086,950 | A | 2/1992 | Crossdale et al. | |
| 5,102,010 | A * | 4/1992 | Osgar et al. | 222/1 |
| 5,265,801 | A | 11/1993 | Larson | |
| 5,280,764 | A | 1/1994 | Levinrad | |
| 5,360,127 | A | 11/1994 | Barriac et al. | |
| 5,366,584 | A | 11/1994 | Zukowski et al. | |
| 5,390,852 | A | 2/1995 | Schuenemann et al. | |
| 5,452,485 | A | 9/1995 | Ross | |
| 5,716,007 | A | 2/1998 | Nottingham et al. | |
| 5,823,390 | A | 10/1998 | Muderlak et al. | |
| 5,836,482 | A | 11/1998 | Ophardt et al. | |
| 5,842,682 | A | 12/1998 | Schennum et al. | |
| 5,848,736 | A | 12/1998 | Boumann | |
| 5,853,034 | A | 12/1998 | Edwards et al. | |
| 6,006,388 | A | 12/1999 | Young | |
| 6,036,056 | A | 3/2000 | Lee et al. | |
| 6,095,370 | A | 8/2000 | Rhine et al. | |
| 6,142,750 | A | 11/2000 | Benecke | |
| 6,269,837 | B1 * | 8/2001 | Arent et al. | 137/614.04 |
| 6,321,941 | B1 | 11/2001 | Argentieri et al. | |
| 6,328,543 | B1 | 12/2001 | Benecke | |
| 6,386,392 | B1 | 5/2002 | Argentieri et al. | |
| 6,390,329 | B1 | 5/2002 | Maddox | |
| 6,390,335 | B1 | 5/2002 | Lawson et al. | |
| 6,463,600 | B1 | 10/2002 | Conway et al. | |
| 6,554,791 | B1 | 4/2003 | Cartledge et al. | |
| 6,626,332 | B2 * | 9/2003 | Ehrensperger et al. | 222/190 |
| 6,651,270 | B1 | 11/2003 | Porter | |
| 6,758,372 | B2 | 7/2004 | Studer et al. | |
| 6,971,549 | B2 * | 12/2005 | Leifheit et al. | 222/83 |
| 7,021,494 | B2 | 4/2006 | Mazooji et al. | |
| 7,308,990 | B2 | 12/2007 | Mazooji et al. | |
| 7,635,097 | B2 | 12/2009 | Mazooji et al. | |
| 2008/0048050 | A1 | 2/2008 | Mazooji et al. | |

FOREIGN PATENT DOCUMENTS

| | | | |
|---|---|---|---|
| EP | 0949006 | | 10/1999 |
| EP | 1 118 300 | A1 | 7/2001 |
| EP | 1 190 653 | A1 | 3/2002 |
| EP | 1 191 166 | A1 | 3/2002 |
| EP | 1 191 167 | A1 | 3/2002 |
| JP | 10-328059 | | 12/1998 |
| WO | WO 01/23510 | A2 | 4/2001 |
| WO | WO 01/52709 | A1 | 7/2001 |
| WO | WO 01/52710 | A1 | 7/2001 |
| WO | WO 00/32315 | A1 | 3/2002 |
| WO | WO02084034 | | 10/2002 |

* cited by examiner

FIG. 1
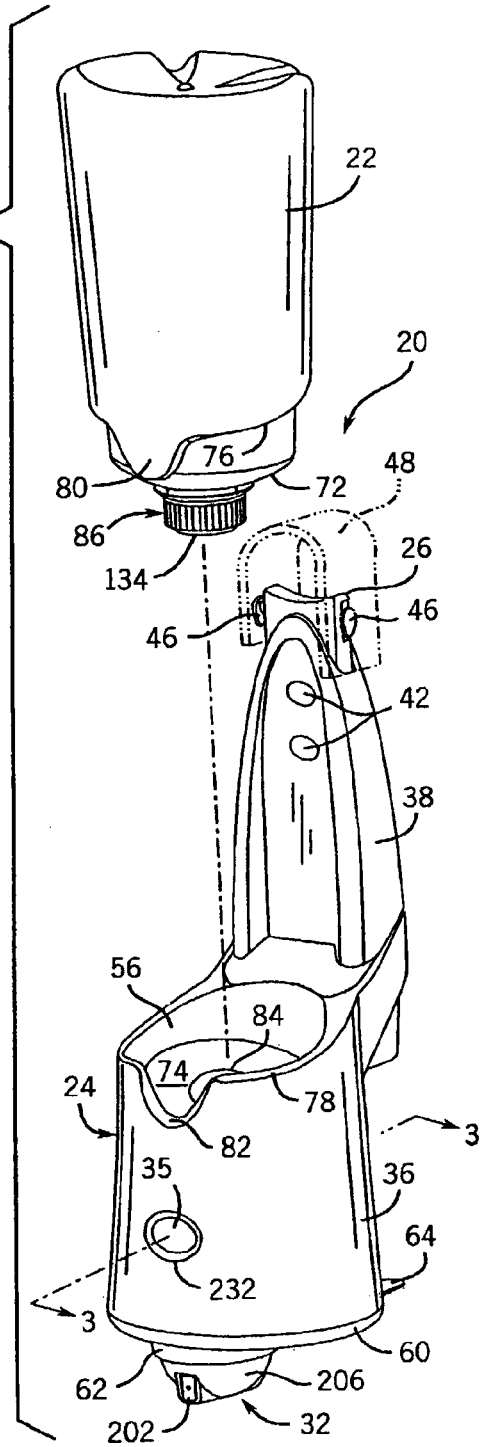
FIG. 8
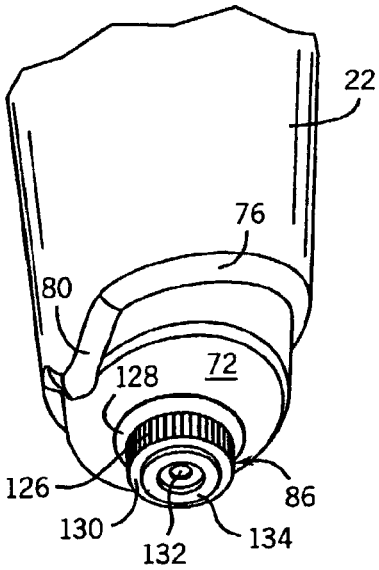
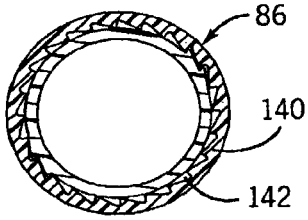
FIG. 13

168
162
160
28
156

42
50
38
44
22
56
24
4
98
86
68
96
36
84
97
70
66
97
232
5
35
166
182
192
6
6
64
216
202
4
5
32
206

AUTOMATED CLEANSING SPRAYER

CROSS-REFERENCE TO RELATED APPLICATIONS

This patent claims priority based on U.S. provisional patent application 60/383,687 filed on May 28, 2002, and is a divisional of U.S. Ser. No. 10/439,467 filed May 16, 2003 now U.S. Pat. No. 7,837,132, now allowed.

STATEMENT OF FEDERALLY SPONSORED RESEARCH OR DEVELOPMENT

Not applicable.

BACKGROUND OF THE INVENTION

This invention relates to sprayers that are designed to automatically clean enclosures. It appears to be especially well suited for automatically cleaning shower/bathing enclosures of the type typically found in homes.

The walls and doors of shower/bathing enclosures can become mildewed, coated with soap build up or hard water and mineral deposits, or become otherwise soiled, during typical use. Removing these deposits and stains normally requires one to scrub the walls and doors by hand, which is an undesirable task.

To assist in this task, cleaning chemicals may be sprayed, squirted, or otherwise applied on the surfaces to be cleaned. After allowing the active ingredients some time to "work", the walls are then wiped with a cloth, brush, or scrubbing pad, and then rinsed with water.

In some cases these cleaners are so effective that the amount of scrubbing can be somewhat reduced (particularly if the cleaners are used on a daily basis). See generally, WO 96/22346 and WO 98/02511.

However, for these "no scrub" cleaners to work well they preferably should be applied immediately after the shower has been used. This requires a consumer to keep a pump spray bottle of the cleanser in or near the shower enclosure (further cluttering the shower area), that the consumer remember to do the spraying (which may be problematic if the consumer has just woken up), and that the consumer be willing to spend the time to spray the enclosure (for example they may be running late in the morning).

An alternative approach is to provide an automated cleaning system for a shower. For example, U.S. Pat. No. 4,872,225 discloses a sprayer and conduit system for a bath and shower enclosure. The unit is associated with the showerhead. Supply water can be diverted to the sprayer for cleaning the enclosure. A container of cleanser is mounted in the shower enclosure for introducing cleanser (through an injector assembly) for spraying cleanser on the walls.

A drawback with this system is that the user must manually turn on the supply water (if not already on), adjust the diverter, squeeze cleanser into the sprayer and shut off the water after the walls have been washed. There is also some risk that the consumer will be sprayed with the cleanser.

Other automated enclosure cleaning systems are more elaborate, such as that disclosed in U.S. Pat. No. 4,383,341, which includes multiple pop-out spray nozzles connected by a manifold to a mixing valve where cleaning concentrate is mixed with water. Thus, it is not something that a consumer can easily and inexpensively retrofit to their shower enclosure.

U.S. Pat. No. 5,452,485 discloses an automatic cleaning device for a tub and shower having large, powered tub and shower "gliders" that move in tracks around the tub and shower stall, respectively. The gliders are coupled to the water supply, which is mixed with a cleanser. The gliders have spray heads for spraying the cleaning solution on the tub and shower walls. The gliders also have brushes for scrubbing the walls. A user operates the gliders and cleanser mixing by a central controller. Again, this system is not suitable for easy and inexpensive retrofitting.

It seems particularly desirable to develop a relatively small automated dispenser that can be hung from a showerhead, shower enclosure wall, or the like, yet dispense cleanser without the need for drawing water from the building supply. It would also be desirable for such a system to accept inverted bottles of cleaning fluid, and use a battery operated electric motor to dispense the cleaning fluid from the bottle. It would be even more preferred for such a system to delay flow for a time after the system was activated, and then shut the system down after a defined time. Thus, the consumer would be given time to exit the enclosure before the spray started, and the consumer would not need to stay around to turn the equipment off.

However, developing such a system has significant challenges. For example, it is desirable to achieve reliable cleaning at very low cost, to provide for reliable control of the flow of cleaning fluid to avoid wasting fluid or missing areas of the enclosure, and to provide for control over the types of cleaning fluid that can be used with the equipment. The present invention seeks to address these needs.

SUMMARY OF THE INVENTION

In one aspect the invention provides an automated sprayer for spraying an enclosure with a liquid cleanser. The preferred enclosures are bath and/or shower enclosures. However, other enclosures may also be cleaned using the invention (for example a toilet bowl where the unit is mounted on the underside of the toilet bowl cover).

The sprayer has a reservoir suitable to contain the liquid cleanser (for example a cleanser such as that described in WO 96/22346), a pump in fluid communication with the reservoir, and a movable spray head having an outlet orifice through which cleanser from the reservoir can be expelled during operation of the pump if there is liquid cleanser in the reservoir. There is also a motor drive mechanism for operating the pump and also moving the spray head.

In preferred forms the pump is connected to the spray head by a fluid line, the fluid line has a valve interrupting flow to the spray head when the pump is not operating, there is a filter in line with the fluid line upstream from the valve, and the fluid line is connected to the spray head via a junction such that the fluid line connects to the junction at an inlet fixed with respect to the sprayer and wherein the spray head connects to the junction via a rotatable shaft. That shaft provides a fluid passageway in communication with the inlet, the shaft has a forked end mounting the spray head, the junction includes a resilient seal disposed about the shaft, and the junction includes a removable cap including the inlet. If desired the cap can mount to a wall of a stationary plate supporting the drive mechanism.

In another aspect the sprayer has a bottle suitable to contain the liquid cleanser, a reservoir tray supporting the bottle in an inverted orientation, a spray head having an outlet orifice through which cleanser from the bottle can be expelled if there is such liquid cleanser in the bottle, and a piercing post extending from the reservoir tray into the bottle, the post also providing an air vent pathway. There can be a check valve controlling air flow to the piercing post and inhibiting fluid flow out through the piercing post.

This variant facilitates the flow of fluid from the bottle (for example overcomes any negative pressure effect in the bottle). However, it does so in a manner that avoids the air being added in a way that causes frothing or foaming. The air passes up the piercing post away from the lower outlet of the bottle.

In yet another form the invention provides a dispenser for dispensing a liquid. There is a bottle suitable to contain the liquid, a reservoir tray having an upwardly extending well for supporting the bottle in an inverted orientation, and a cap closing a top end of the bottle. The well has a spring-loaded outlet valve that permits outflow from the well when a portion of the cap abuts against the outlet valve. The cap can also have a radially extending web to form a seal against a side of the well. In a preferred form the dispenser is an automated sprayer for dispensing a liquid cleaner.

There can also be other features to help insure that only approved bottles are used with the system. For example, the shape of the receiving well for the bottle can be uniquely sloped or contoured to conform to similar shapes on the bottle.

These structures insure that air does not vent in an uncontrolled manner into the fluid supply. They also insure that only specially designed bottles can be used with the system (thereby inhibiting the use of inappropriate chemicals).

In still another form the sprayer is provided with a hanger that is adjustable from a first compact configuration to a second hanger configuration. The hanger is in the form of a tower having a cavity and a slider, the slider engaging the tower in a tab and slot arrangement.

This construction permits the unit to be shipped in a carton having a relatively short length. However, the consumer can extend the slider as needed to provide sufficient hanging length.

In another form the invention provides an assembly for coupling a fluid line to a rotatable nozzle. There can be a fluid inlet line, a rotatable nozzle, a chamber attached to the fluid inlet line and rotationally fixed with respect thereto, a seal disposed within the chamber, and a shaft having an end disposed within the chamber about which the seal is disposed and an opposite end connected to the nozzle, the shaft both being rotatable and defining a passageway in communication with the chamber and the nozzle. This structure provides a means of attaching the supply line to the rotatable showerhead, while keeping the risk of leakage to the minimum.

In preferred forms there can be an o-ring and a cap having an annular surface projecting into the chamber radially outside the shaft so as to contact the o-ring and press the o-ring.

As will be appreciated from the above and the discussion below, various aspects of the invention have substantial advantages. For one thing, the electric motor performs a dual function of driving the pump and also rotating the showerhead. It therefore provides an extremely efficient solution for delivering well defined amounts of cleaning fluid to a substantial area of an enclosure to be cleaned.

The problem of negative pressure build-up in the bottle, or uncontrolled air venting, is also addressed by the present invention. Further, means are provided between the bottle and its receiver to help insure that the bottle is not refilled once exhausted, and to help insure that differently designed bottles are not substituted for those best suited for use with the equipment.

Concerns regarding potential leakage or backflow are also addressed by the present invention, and the product is designed to be compactly shipped and adjustably mounted.

These advantages are achieved by an assembly that can be constructed of relatively inexpensive components, at a relatively low cost. Thus, it is a practical alternative to hand held spray cleaners.

Further, the invention is suitable for use with control systems that (i) delay the start of spraying for a defined period once the unit is activated (to provide time for a consumer to exit the enclosure), (ii) provide automatic shut-off (so that a consumer may leave to go to work or other activities without waiting for the cleaning cycle to end) and (iii) provide audible or visual (for example flashing light) warnings when the system is about to turn on so that the cleaner is not likely to be sprayed on the consumer by accident.

The power usage of this system is quite low as it only needs to be operated for a short period during the cleaning process. Thus, it can be battery powered, thus avoiding problems that would arise should room power have been needed.

These and other advantages of the invention will be apparent from the detailed description which follows and the drawings. It should be appreciated that what follows is merely a description of preferred embodiments. That description is not meant as a limitation of the full scope of the claims. Rather, the claims should be looked to in order to judge the full scope of the invention.

BRIEF DESCRIPTION OF THE DRAWINGS

FIG. 1 is a perspective view of an automated sprayer of the present invention with a cleanser bottle shown inverted prior to being set into the sprayer;

FIG. 8 is a partial reverse perspective view of the cleanser bottle with its bottle cap;

FIG. 13 is a cross-sectional view taken along line 13-13 of FIG. 10.

DETAILED DESCRIPTION OF THE PREFERRED EMBODIMENTS

Figure 2A:
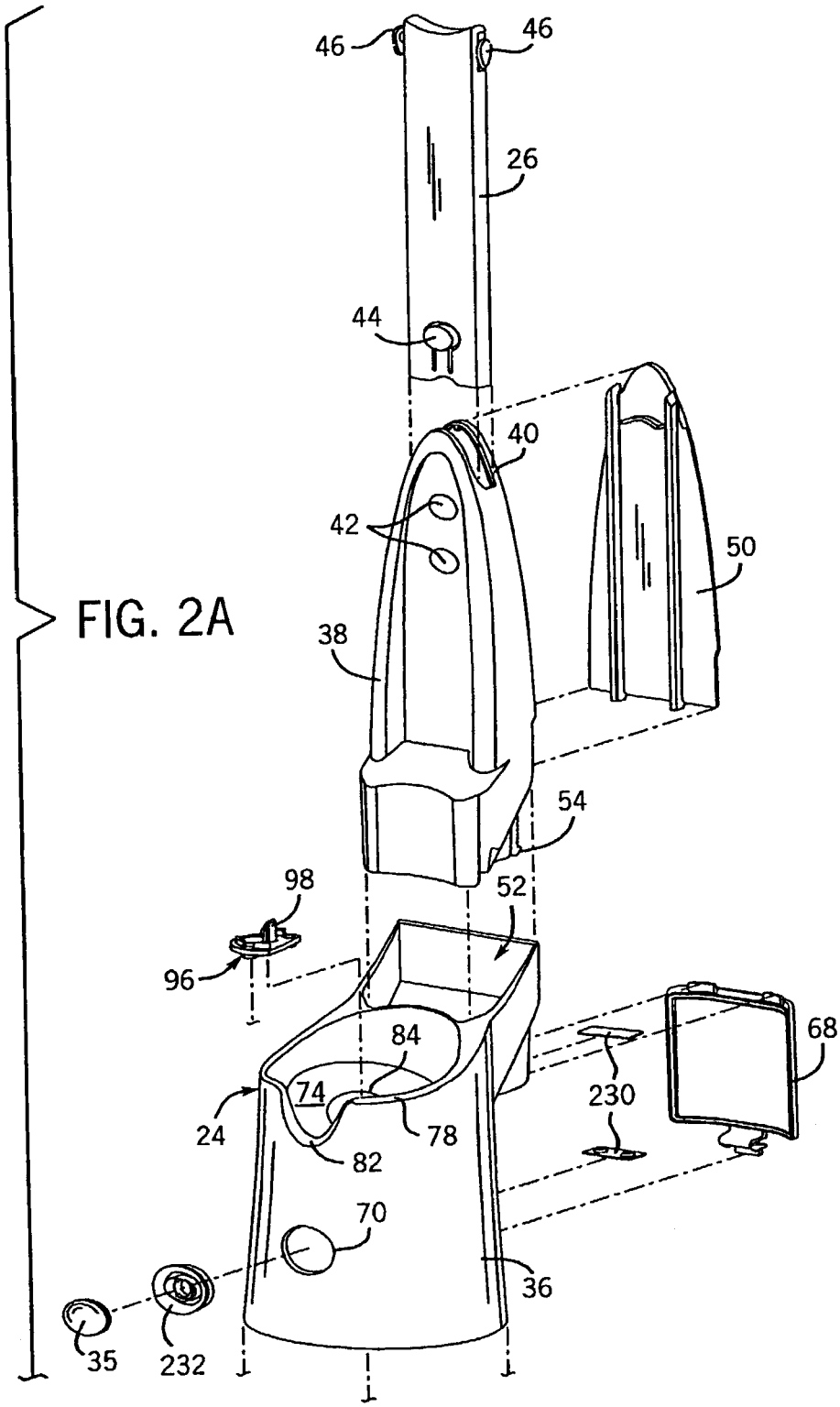
FIGS. 2A and 2B are exploded perspective views of the sprayer of FIG. 1.
Figure 2B:
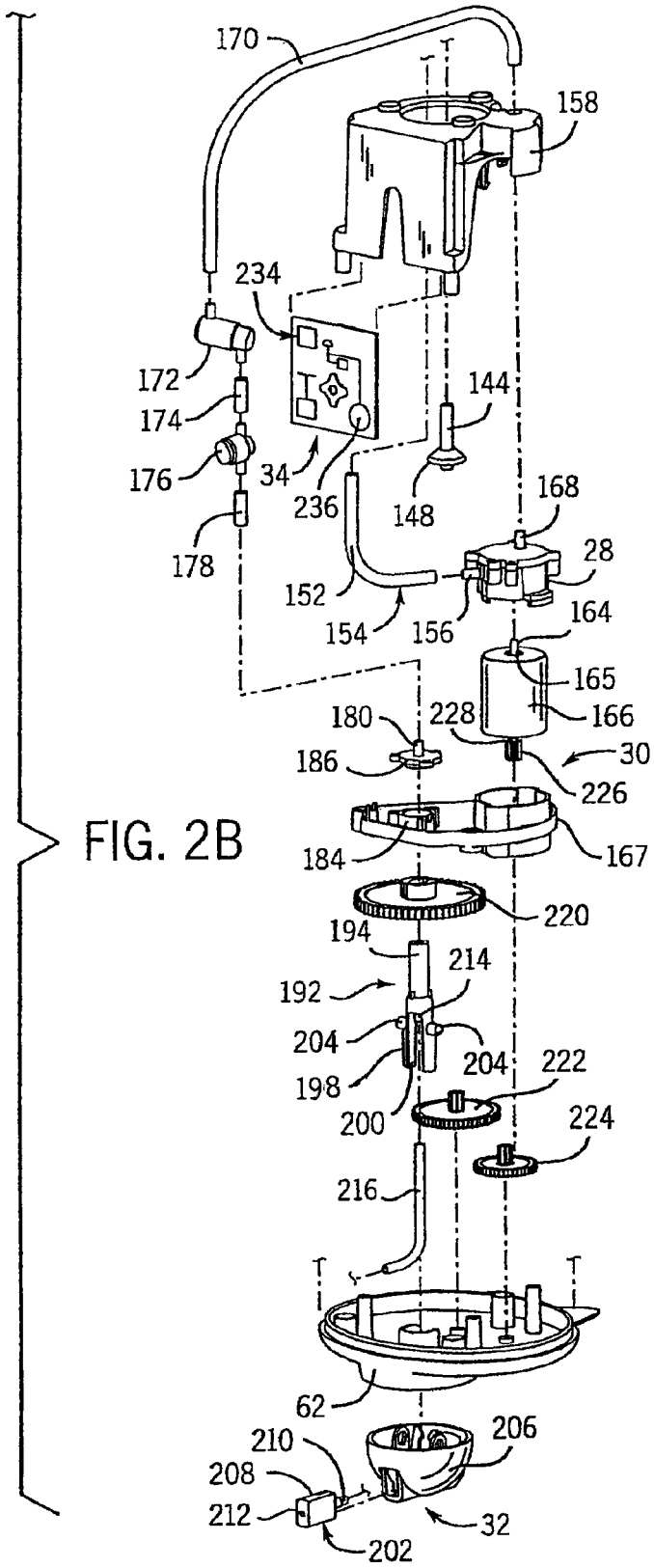
Figures 2C, 3:
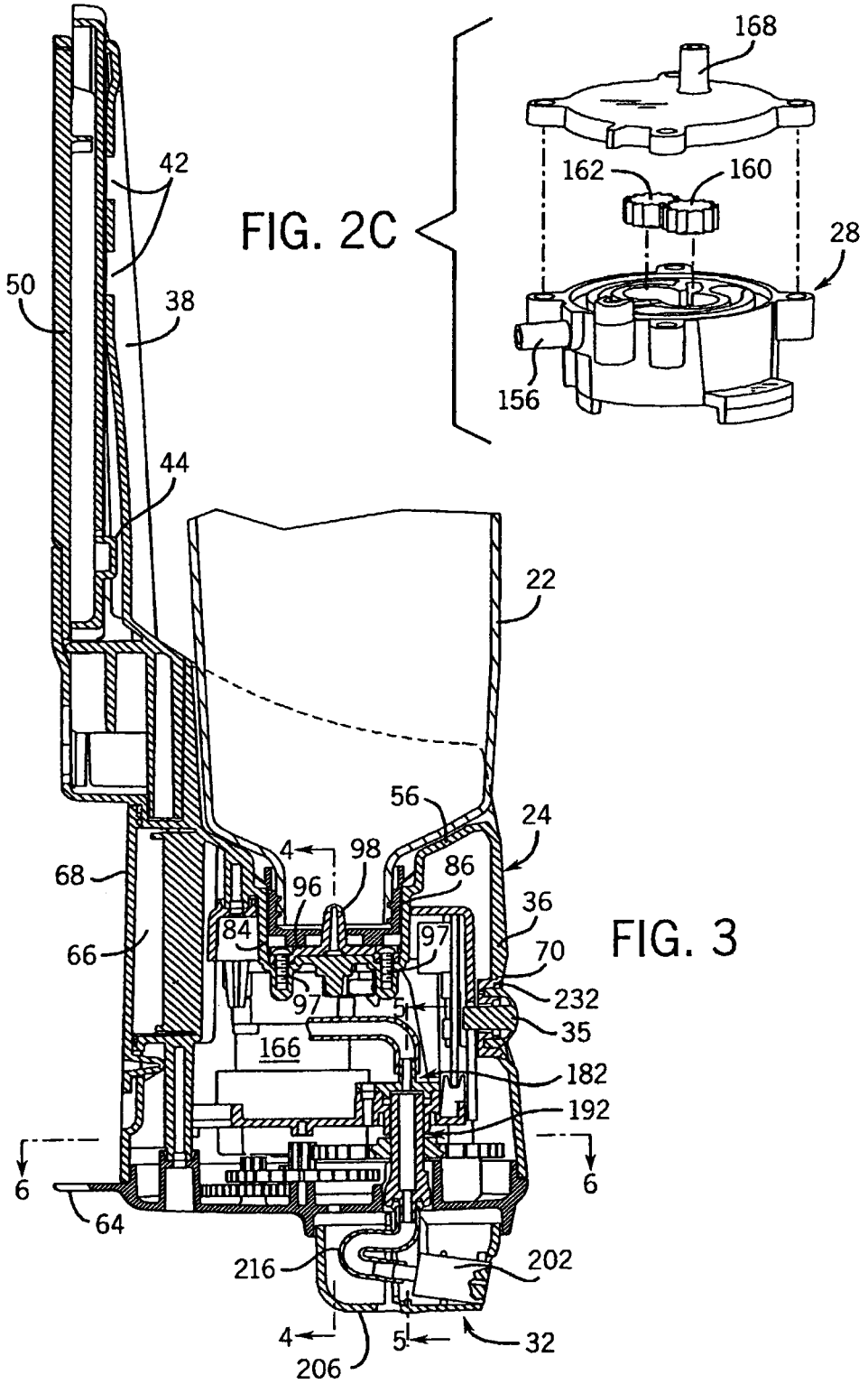
FIG. 2C is an exploded perspective view of one possible pump used in the sprayer.
FIG. 3 is a side cross-sectional view of the sprayer taken along line 3-3 of FIG. 1.

The automated sprayer of the invention is generally referred to in the figures by reference number 20. With particular reference to FIGS. 1-2B, the sprayer 20 includes as main components a bottle 22, a housing 24 with an adjustable hanger 26, a pump 28, a drive mechanism 30, a spray head 32 and a control circuit 34. The sprayer is typically suspended via the hanger from a shower spout or the like and then activated via a button 35 at the front of the sprayer to rotate a spray head and pump cleanser from the bottle out of the spray head during a spray cycle of a prescribed time period, after which dispensing is automatically terminated.

The exterior of the sprayer is defined by the housing 24, which can be molded from, for example, plastic by any suitable technique and consists primarily of two pieces, a receptacle 36 and a hanger tower 38 that easily snaps into a pocket in the receptacle. This allows the sprayer to be shipped and stored in a compact package with minimal assembly by the consumer. The hanger tower 38 is an upright member defining a cavity in which the elongated body of the hanger 26 fits through an opening 40 at its upper end. The upper end of the hanger tower 38 has two oval openings 42 vertically spaced apart.

A deflectable tab 44 formed in the lower end of the hanger can snap into one of the openings to lock the hanger at either of two extended positions. The hanger is extended and locked in the lower opening by simply pulling it away from the hanger tower. In this position, the sprayer 30 will hang from standard shower spouts at an appropriate height for spraying down the shower walls. The height can be adjusted by depressing the tab inwardly and sliding the hanger up or down. The hanger itself has two ears 46 at its upper end for mounting a rubber strap 48. The ears can be tapered to ease connection of the strap, which can have a series of holes at one end for adjustment purposes so that the strap fits tightly around a shower spout or the like. The back side of the hanger tower is closed by a back plate 50. The hanger tower connects to the receptacle at its lower end, which fits into a pocket 52 and has two latches 54 (one shown) that snap into two slots in the back of the receptacle.

Figure 4:
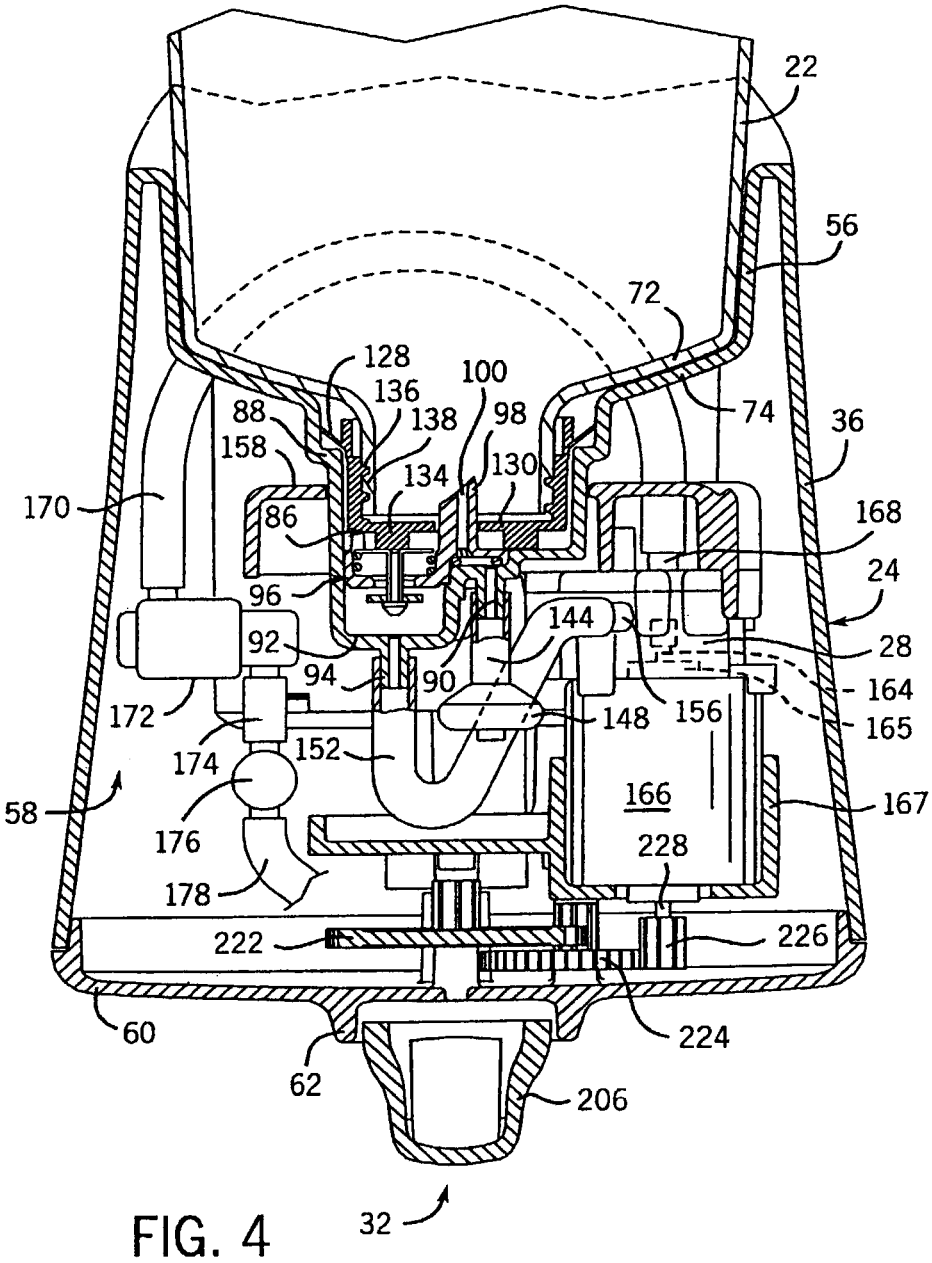
FIG. 4 is a partial cross-sectional view taken along line 4-4 of FIG. 3 showing the pump and drive mechanism with the pump and a drive motor shown in full.

The receptacle defines an upwardly opening bottle tray 56 above a compartment 58 (see FIG. 4) containing the pump and drive mechanism which is closed at the bottom by a cover 60. The cover has a circular skirted opening 62 for the spray head and a wall stand-off 64 extending backward the distance of the pocket to brace the lower end of the receptacle against the wall and keep it plumb. The back side of the receptacle defines a battery compartment 66 with a lid 68 and the front side has an oval switch opening 70 for the control button 35.

The tray 56 is formed to mate with a specially contoured upper end of the bottle. The bottle and tray are generally oval and have mating seating surfaces 72 and 74 and sloped shoulders 76 and 78 with complementary V-shaped features 80 and 82, respectively. These features and the contour of the shoulders fix the orientation of the bottle in the tray and make conventional cleanser bottles incompatible with proper operation of the sprayer.

Referring next to FIGS. 9-12, the tray defines a circular well 84 at the center of the seating surface 74 accommodating a special cap 86 screwed onto the mouth of the bottle. The well is formed with a shoulder portion 88, a vent nipple 90 and a recess 92 with a discharge nipple 94. The well supports a valve plate 96 (see FIG. 2A) fastened thereto by two screws 97 (see FIG. 3). The valve plate has a piercing post 98 projecting up from the valve plate. The post has a slanted top end defining a sharp point and defines a vent passageway 100 and three radial ribs 102. The vent passageway extends into a recess 104 at the underside of the valve plate accommodating a small o-ring 106 surrounding the vent passageway and the opening in the vent nipple 94. The valve plate also defines a valve recess 108 with a discharge passageway 110 through which a valve stem 112 extends. The upper end of the valve stem has a cross-shaped plunger 114 that is biased away from the well by a coil spring 116 fit into the valve recess.

Figure 10:
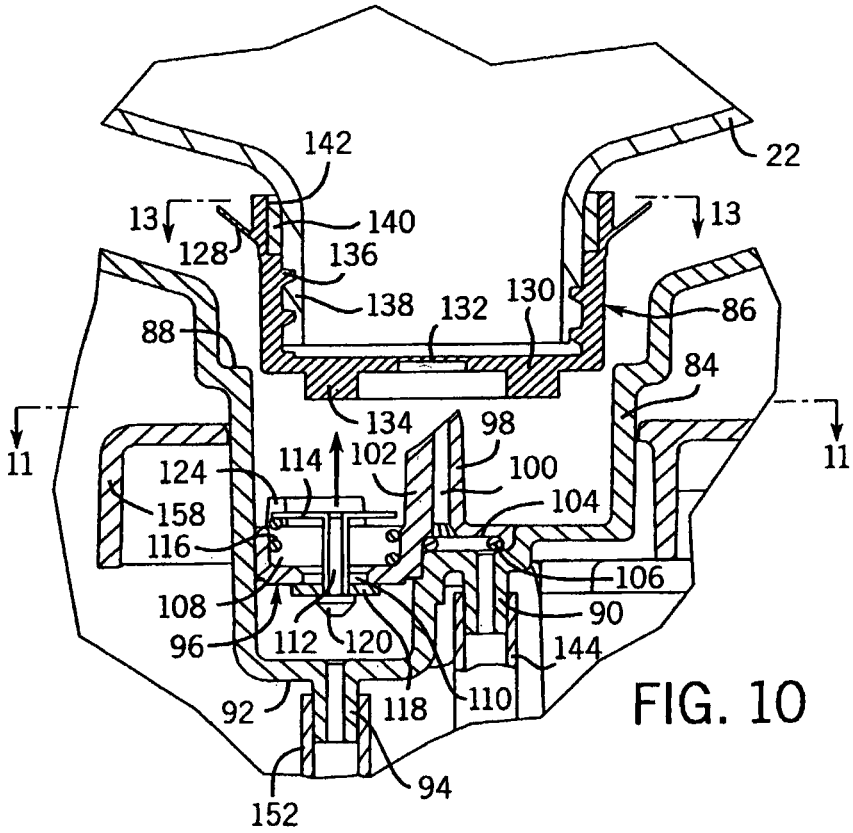
FIG. 10 is a view similar to FIG. 9 although with the bottle unseated from the tray and the discharge valve closed.
Figure 11:
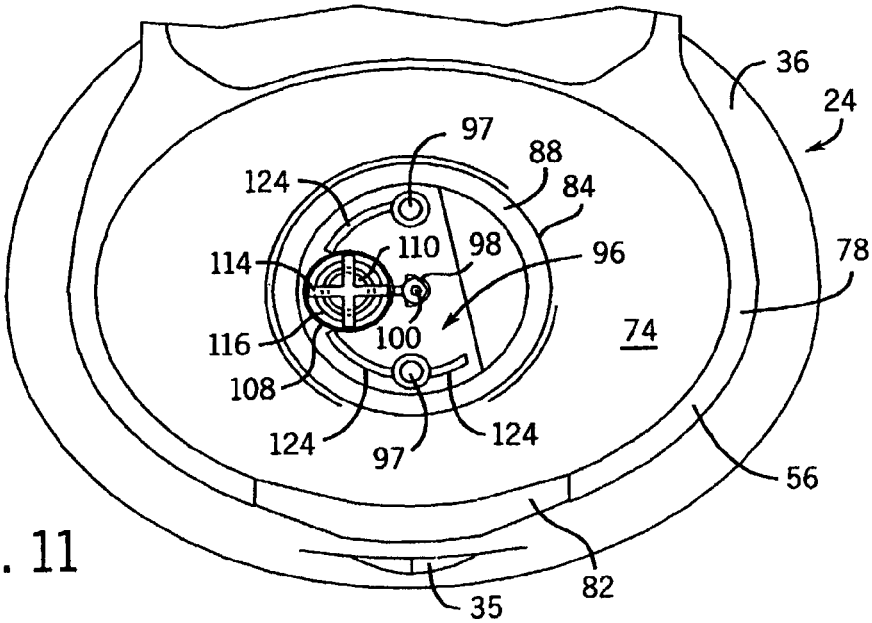
FIG. 11 is a top view of the tray with the bottle removed.
Figure 12:
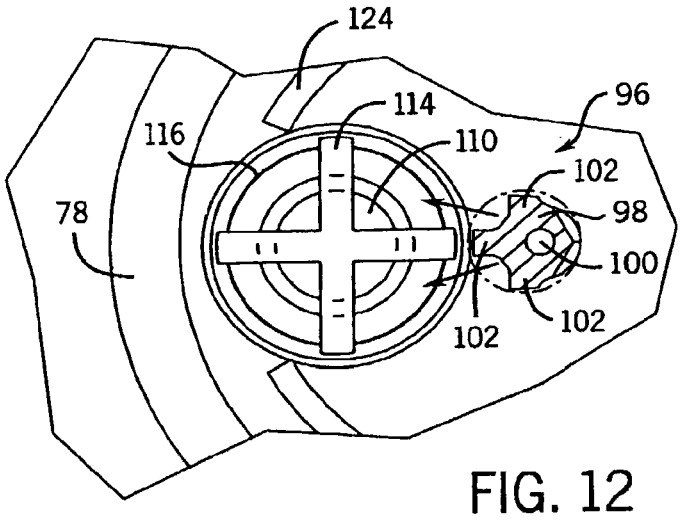
FIG. 12 is an enlarged partial top view showing the discharge valve and piercing post.

The lower end of the valve stem mounts a disc-shaped rubber gasket 118 retained by an enlarged end 120 of the valve stem. As shown in FIG. 10, the plunger is biased upward by the spring so that the gasket seals against the underside of the valve plate so as to close off the discharge orifice when the sprayer is not being used. The valve plate also defines arcuate stand-offs 124 spaced in slightly from its periphery. The valve plate and the well are designed to cooperate with the specially designed bottle cap (described below) to discourage use of unaffiliated cleanser and thereby promote proper operation of the sprayer.

Referring next to FIGS. 8-11, the cap is generally circular with a serrated periphery 126 and a tapered sealing flange (or web) 128 that seals against the tray well above its shoulder. The top of the cap has an outer surface 130 with a recessed thinned area 132 at its center around which is a raised ring surface 134 extending to a plane spaced from surface 130. The thinned area 132 is located so that as the bottle is seated in the tray the piercing post will puncture the cap in this area to permit discharge of the cleanser and venting of the bottle. The raised ring is located to contact the plunger of the valve and push the valve downward to unseat the gasket from the plate and open the discharge orifice. The flat surface 130 of the cap rests on the stand-offs 124 to space the punctured area from the floor of the well.

This arrangement thus provides a no-mess means of opening and inserting the bottle, but also further inhibits uses of improper cleanser containers. It does this for several reasons. First, if a conventional bottle and cap were inserted into the tray, the piercing post would not puncture a conventional cap lacking the weakened area. Even if the cap was removed so that the mouth was opened, the sprayer still would not operate because the valve is located radially inward of the place where a conventional thin-walled bottle mouth would normally extend so that the valve would not be opened.

Another feature that serves this purpose is the conforming sloping of the bottle shape and receiving well. A bottle not having a complementary shape would not be received sufficiently low to activate the outlet valve.

Also, while the cap has conventional internal threads 136 at its upper end that mate with threads 138 on the mouth of the bottle, and it also has a ring of one-way ratchet teeth 140 that engage corresponding ratchet teeth 142 on the bottle (see FIG. 13). The ratchets allow the cap to be turned in a tightening direction but resist untightening rotation to prevent non-destructive removal of the cap and thus refilling of the bottle.

FIGS. 2B-6 show the pump, controller, and drive mechanism contained inside the receptacle compartment beneath the bottle tray. These components will now be described working from the bottle-tray interface to the spray head. A short vent tube 144 couples to the vent nipple 146 defining the vent orifice in the tray well. A small check valve 148 fits into the end of the vent tube. The check valve is normally closed so that cleanser does not leak out via that path. The valve opens by negative pressure that develops as cleanser is withdrawn from the bottle. The opened check valve aspirates the air to the bottle to allow the cleanser to flow from the bottle in a consistent manner, without introducing air in a manner that would cause foaming or gurgling. The check valve remains open until the pressure in the bottle has equalized sufficiently to alleviate the negative pressure and then it closes.

From the discharge nipple defining the discharge orifice of the tray well a first tube 152 of a dispenser line 154 extends to an inlet barb 156 of the pump 28, which snaps into a support 158 mounted to the underside of the bottle tray. The pump can be any conventional pump, such as a diaphragm pump, a piston pump, a peristaltic pump, or even a gear pump as shown. The inlet defines a passageway leading between intermeshing drive gear 160 and idler gear 162 (see FIG. 2C). The drive gear is connected to an upper shaft 164 (surrounded by o-ring 165) of a direct current motor 166 mounted through an opening in a gear plate 167 mounted to the lower cover of the receptacle. Operation of the motor rotates the drive gear which meshes with and turns the idler gear as conventional to draw cleanser from the bottle and through to an outlet barb 168. A second tube 170 connects the outlet barb to a filter 172. The filter accumulates cleanser within its housing and aids in priming the pump. A short tube 174 of the dispenser line connects the filter 172 to another check valve 176 which is connected by another short tube 178 continuing a spring 179 for support to an inlet barb 180 of a shaft junction 182.

Figure 5:
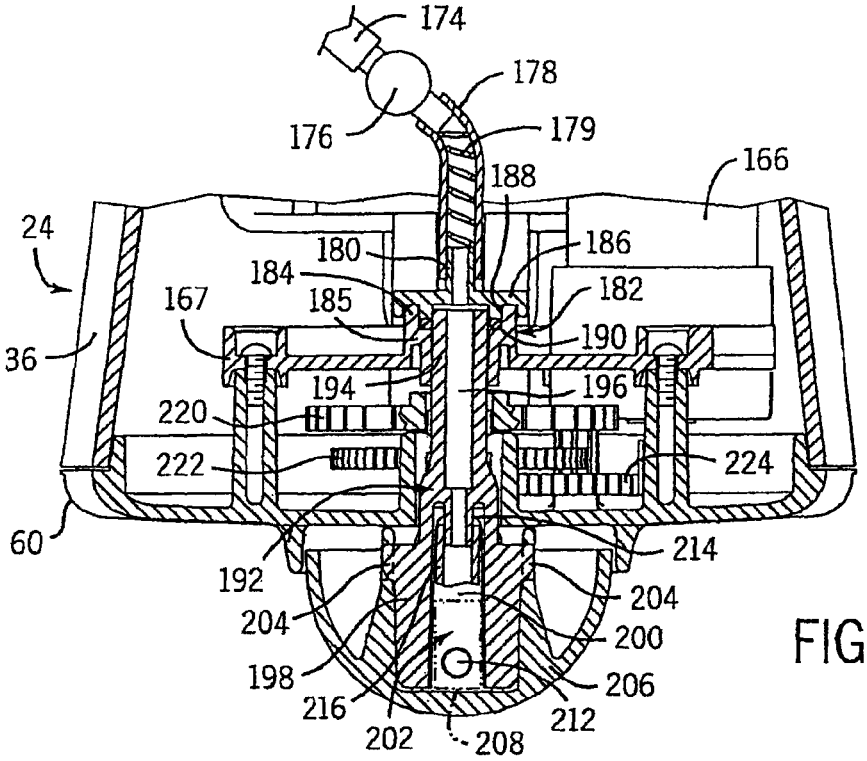
FIG. 5 is a front cross-sectional view taken along line 5-5 of FIG. 3 showing the spray head drive and junction with the dispenser tube.
Figure 6:
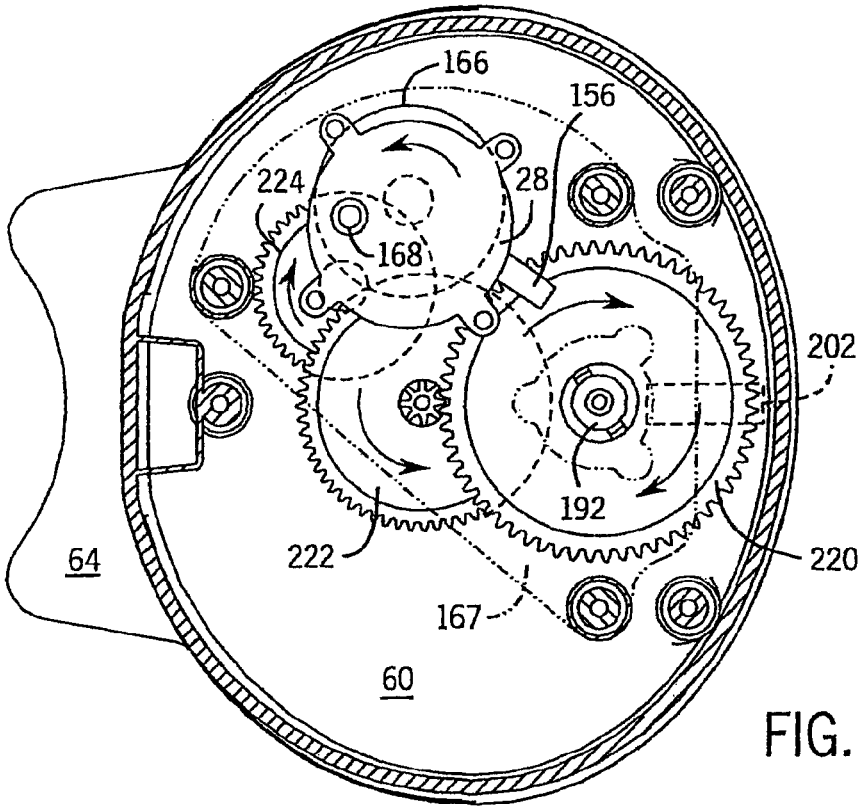
FIG. 6 is a cross-sectional view taken along line 6-6 of FIG. 3 showing the gear train for the spray head drive.

Referring to FIGS. 2B and 5, the stationary portion of the junction 182 is a chamber formed in part by the gear plate at a circular wall 184 having an inner shoulder 185 and covered at one end by a cap 186. The cap includes the inlet barb 180 and a raised annular ring 188 extending downwardly within the circular wall to press an o-ring 190 against the shoulder. The o-ring seals against the upper end of a rotating spray head drive shaft 192, which forms the rotating portion of the function. The drive shaft is an inverted Y-shaped structure with a cylindrical stem 194 defining a passageway 196 and a forked end 198 extending down through an opening in the receptacle cover and defining a gap 200 accommodating a spray nozzle 202. The forked end has lateral mounting posts 204 onto which snaps a dome-shaped cover 206 concealing the spray nozzle 202.

The spray nozzle is preferably a fluidic oscillator providing oscillating spray (in this case up and down), however, any other suitable nozzle could be used. See e.g. U.S. Pat. No. 4,562,867 which shows examples of known fluidic oscillators. Such a fluid oscillator can be any suitably sized oscillator including a housing 208 with an inlet 210 and an outlet 212 on opposite sides. A barrier member (not shown) in the interior of the housing defines a passage between the inlet and the outlet so that cleanser entering the inlet passes through and around the barrier member to the outlet. The fluidic oscillator operates, as known in the art, by creating areas of low pressure at alternate sides of the passage through the barrier member to convert the straight flow entering the housing to an oscillating pattern.

The nozzle is coupled to an outlet barb 214 extending from the stem by another tube 216. The nozzle is mounted so that its outlet end extends through the opening in the cover pointed downwardly at approximately a 30 degree angle. A drive gear 220 is press fit onto the stem of the drive shaft and meshes with a first reducer gear 222 which is rotated by another smaller diameter reducer gear 224 driven by a pinion 226 at the end of lower motor shaft 228. The gear train couples to the motor to the spray head at a reduced revolution per minute rate than the motor shaft. This arrangement provides a revolving, oscillating spray pattern.

Also mounted to the support within the receptacle compartment is the control circuitry 34 which is electrically coupled to a direct current power supply via battery terminals 230 (see FIGS. 2A and 7) in the battery compartment and to the push-button switch 35, which is mounted through the opening 70 in the front of the receptacle through a lighted watertight, flexible membrane 232. The circuitry includes timing circuitry 234 and a speaker 236 that functions as described below.

Figure 7:
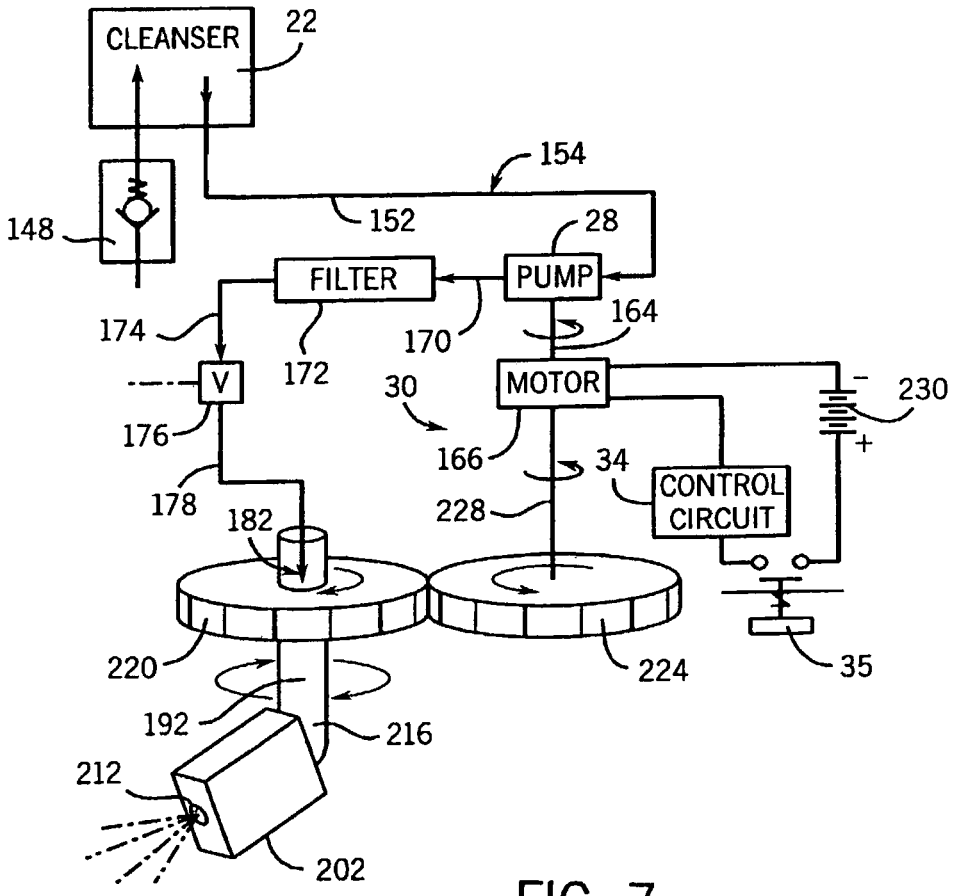
FIG. 7 is a schematic diagram showing the control circuit and cleanser flow path.
Figure 9:
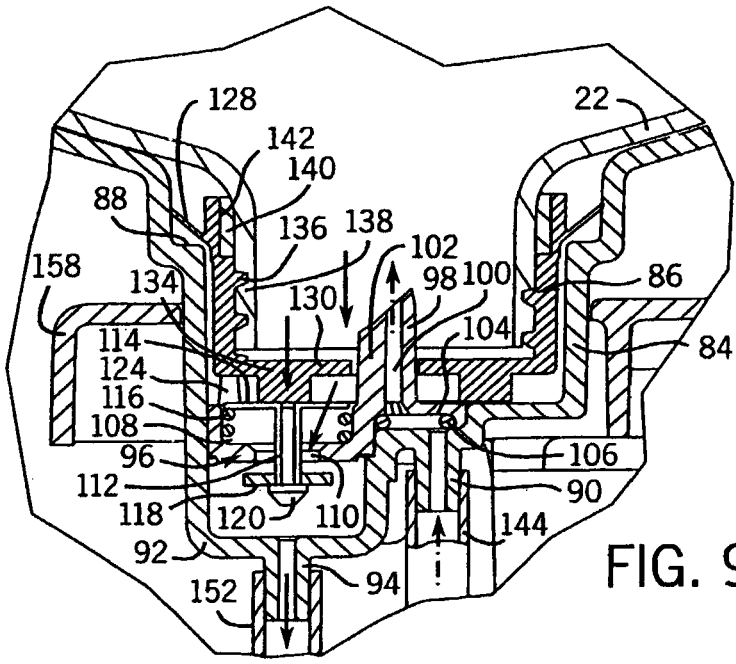
FIG. 9 is an enlarged view of the bottle-tray interface with the bottle seating in the tray and a discharge valve open.

The electrical arrangement as well as the dispensing line and bottle venting flow paths are shown in FIG. 7 and the sprayer is operated as follows. When a bottle is loaded into the sprayer (that is, the bottle is inverted and set into the receptacle tray), the thinned area of the bottle cap is punctured by the piercing post, the cap sealing flange seals against the tray well and the annular ring contacts and depresses the plunger of the discharge valve to open the valve. Cleanser pours out of the bottle between and around the ribs of the piercing post and is replaced by an equal volume of air through the vent tube.

Because air is lighter than the cleanser, it is displaced to the top of the bottle where it is trapped. Cleanser pours out of the bottle and drains through the valve plate and into the dispenser line, through the pump, past the filter until it reaches valve 176. Until the sprayer is operated, the sprayer remains in this state of equilibrium in which no cleanser flows from the bottle.

When a user wishes to spray the enclosure walls with cleanser, he or she simply depresses the switch at the front of the sprayer. This signals timing circuitry to begin a countdown delaying spraying for a predetermined time, such as 20 seconds. This affords the user time to exit the shower enclosure and close the doors or curtains. It also may provide the user time to abort the spray cycle by depressing the switch a second time. Initially depressing the switch may also send a pulsed tone to the speaker and flashes the lighted ring around the switch for warning the user of the impending operation of the sprayer.

Unless cancelled by the user, the spray cycle begins automatically at the expiration of the countdown. The motor is then energized which simultaneously rotates the drive gear of the pump and turns the gear train to rotate the drive shaft and the spray head. At the same time, the pump draws cleanser from the bottle through the dispenser line and opens valve 176 so that cleanser can flow through the junction and be expelled through the nozzle as the spray head is rotated, thereby providing a circular, oscillating spray pattern. This reduces the level of cleanser in the bottle, creating a negative pressure in the bottle, which opens the check valve in the vent tube to aspirate the bottle and allow more cleanser to be drawn from the bottle during the spray cycle.

The motor continues to be energized until the expiration of a second countdown performed by the timing circuit, preferably another 20 second interval, automatically initiated by the timer. At that point the motor is deenergized which shuts down the pump causing valve 176 to close. Closing the valve prevents cleanser from leaking out of the dispenser line and also keeps the cleanser in the line upstream from the valve so that the pump remains primed. The sprayer thus returns to stand-by mode without further intervention from the user, ready for another spray cycle at the demand of the user.

The invention thus provides a device for automatically cleaning a bath and shower enclosure. A simple touch of a button initiates a spray cycle that terminates automatically on completion. Consumers do not need to spend time spraying the shower themselves, and there is less risk of exposure to the cleaning solution. All that is required to replenish the cleanser is simply to remove the old bottle, turn a new bottle upside down, and load it into the tray.

The sprayer automatically meters out the proper volume of cleanser for the spray cycle. The volume can be easily altered for different sized enclosures by increasing or decreasing the duration of the spray cycle. Moreover, the sprayer does not tie into the water supply lines. This makes the device easy to install in existing shower and tub enclosures at any suitable location in the enclosure. It can also be removably mounted without damaging the walls.

It should also be noted that the inventive aspects of the invention could be used to dispense a cleaning or disinfecting solution in applications other than a tub/shower surround. In this regard, U.S. Pat. No. 4,183,105 depicts how one type of automated cleansing equipment could be installed to clean the bowl.

The inventors envision an embodiment of their invention designed to mount to the underside of a toilet bowl cover with the supply cleaning fluid being delivered from a reservoir near the tank, and the chemical being sprayed in the bowl. Such a structure should be considered to be an "enclosure" for purposes of this application.

Preferred embodiments of the invention have been described in considerable detail above. Many modifications and variations to the preferred embodiments will be apparent to those skilled in the art, which will be within the spirit and scope of the invention. For example, hybrids of the disclosed embodiments could be practiced and the electronic timer, motor and user notification system could be replaced by corresponding mechanical (wind-up) systems known in the art. Therefore, the invention should not be limited to the described embodiments. To ascertain the full scope of the invention, reference should be made to the following claims.

INDUSTRIAL APPLICABILITY

The invention provides a sprayer for automatically spraying the walls of bath and shower enclosures and the like.

We claim:

1. A dispenser for dispensing a liquid, comprising:

a bottle containing the liquid;

a reservoir tray having an upwardly extending well for supporting the bottle in an inverted orientation, the well having a piercing post extending vertically and having an air vent passage through the piercing post;

a cap closing a top end of the bottle, the cap having a thinned central region suitable to be pierced by the piercing post; and an automated pump in fluid communication with the bottle;

wherein the well has a spring-loaded outlet valve positioned inside a valve recess of the well so as to be positioned radially outside of the air vent passage, the outlet valve permitting outflow from the well when a portion of the cap drives the outlet valve from a closed position to an open position, the air vent passage housing air that has been supplied through a check valve, the air vent passage being configured to supply air into the bottle interior to the liquid when negative pressure develops in the bottle as liquid is dispensed from the bottle interior, the check valve being positioned and configured to inhibit liquid flow out through the piercing post;

wherein the cap has a radially extending web flange that forms a seal against a side of the well, the seal preventing liquid from flowing past the seal along the well side outside the cap; and wherein the well has a shoulder above a bottom wall of the well and the web flange forms said seal against a side of the well above and directly over that shoulder.

2. The dispenser of claim 1, wherein the dispenser is an automated sprayer for dispensing a liquid cleaner.

3. The dispenser of claim 2, further comprising a hanger attached to the sprayer.

* * * * *